United States Patent [19]

Drummond

[11] Patent Number: 4,494,255

[45] Date of Patent: Jan. 22, 1985

[54] VENTILATED TOILET DEVICE

[76] Inventor: Charles E. Drummond, 861 Chamberlain Ct., New Haven, Ind. 46774

[21] Appl. No.: 555,936

[22] Filed: Nov. 29, 1983

Related U.S. Application Data

[63] Continuation-in-part of Ser. No. 373,869, May 3, 1982, abandoned.

[51] Int. Cl.[3] ..... E03D 9/04

[52] U.S. Cl. ..... 4/213; 4/211

[58] Field of Search ..... 4/211, 213, 217

[56] References Cited

U.S. PATENT DOCUMENTS

| | | | |
|---|---|---|---|
| 2,777,137 | 1/1957 | McFadden | 4/213 |
| 2,847,682 | 8/1958 | Shay | 4/213 |
| 2,985,890 | 5/1961 | Baither | 4/213 |
| 3,763,505 | 10/1973 | Zimmerman | 4/213 |
| 3,999,225 | 12/1976 | Ables | 4/213 |
| 4,085,470 | 4/1978 | Roberts | 4/213 |
| 4,222,129 | 9/1980 | Baker | 4/213 |

*Primary Examiner*—Henry K. Artis

*Attorney, Agent, or Firm*—George A. Gust

[57] ABSTRACT

This invention includes in combination, a flush-type toilet and an odor-removing device comprising a toilet stool having front and rear portions with the front portion being the bowl and the rear portion including a water passage in communication with the bowl. The rear portion has a top side and lateral sides which define the aforesaid passage, the rear portion having a water inlet opening through the top side in communication with the water passage. An odor-removing device is attached to the rear portion for producing a flow of air in a direction from the bowl through the passage and out of one of said sides. A separate port is provided in one side of the device and is disposed in spaced relation from the water inlet opening whereby air can be drawn through the water passage in a direction opposite to the flow of water from the water inlet to the bowl.

5 Claims, 11 Drawing Figures

VENTILATED TOILET DEVICE

CROSS REFERENCE TO RELATED APPLICATIONS

This application is a continuation-in-part of my copending application Ser. No. 373,869 filed May 3, 1982 which is being abandoned upon the filing of the present application.

BRIEF SUMMARY OF THE INVENTION

This invention relates to ventilated toilet stools, and more particularly to a stool provided with an air-removing device by means of which air may be drawn from the toilet bowl and exhausted to the outside of a building in which the stool is installed.

There have been provided devices for ventilating toilet bowls and more particularly for eliminating odorous air from a bathroom stool. Typical of these are disclosed in U.S. Pat. Nos. 2,129,048; 2,329,221; 2,347,682; 2,619,655; 2,724,840; 2,777,137; 3,469,267; 4,085,470; 4,165,544; 4,174,545 and 4,175,293. Difficulties with these prior systems are found in that they are relatively complex and expensive or require extensive modification of existing toilet facilities. Others are not adaptable to pre-existing stools in a simple and economical manner.

In this invention there is provided in combination a flush-type toilet and an odor-removing device comprising, a toilet stool having front and rear portions with the front portion being the bowl and the rear portion including a water passage in communication with the bowl. The rear portion is provided with a top side and lateral sides which define said water passage, and a water inlet opening is provided in the top side in communication with the passage. Means are attached to the rear portion for producing a flow of air in a direction from the bowl through the passage and out of one of the sides. Such means includes a separate port in one of said sides which is disposed in spaced relation from the water inlet opening whereby air can be drawn through the passage in a direction opposite to the flow of water from said inlet to said bowl.

The aforesaid combination may further include a water tank supported by the rear portion of the toilet stool, such water tank having a water discharge opening in the bottom thereof. A suction housing which defines a closed chamber therewithin and interposed in load-bearing relation between the water tank and the top side of the rear portion is provided with top, bottom and side walls. A tubular element is provided in the housing which extends into the chamber from the top wall through which it opens. The bottom wall is provided with an intake port laterally spaced from the tubular element. One of the side walls is provided with an outlet port.

The top side of the stool rear portion having the water inlet opening is disposed in registry with the lower end of the tubular element, and the water discharge opening in the tank is in registry with the upper end of the tubular element whereby water may flow from the tank through the tubular element into the water inlet opening and into said passage thereby to provide flush water for the bowl.

The intake port in the bottom wall of the housing is also in registry with said water inlet opening of said stool whereby pneumatic suction applied to the outlet port in the suction housing causes a current of air to flow from the bowl through the passage into the intake port and chamber, and from the chamber out of said outlet port. Odorous air is thereby conveniently removed from the bowl.

It is an object of this invention to provide an arrangement for ventilating toilet bowls which is economical and functions efficiently to withdraw odorous air from the bowl.

It is a further object of the present invention to provide a toilet ventilating device which is readily retrofit to virtually any present day toilet design.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWING

In the drawings.

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
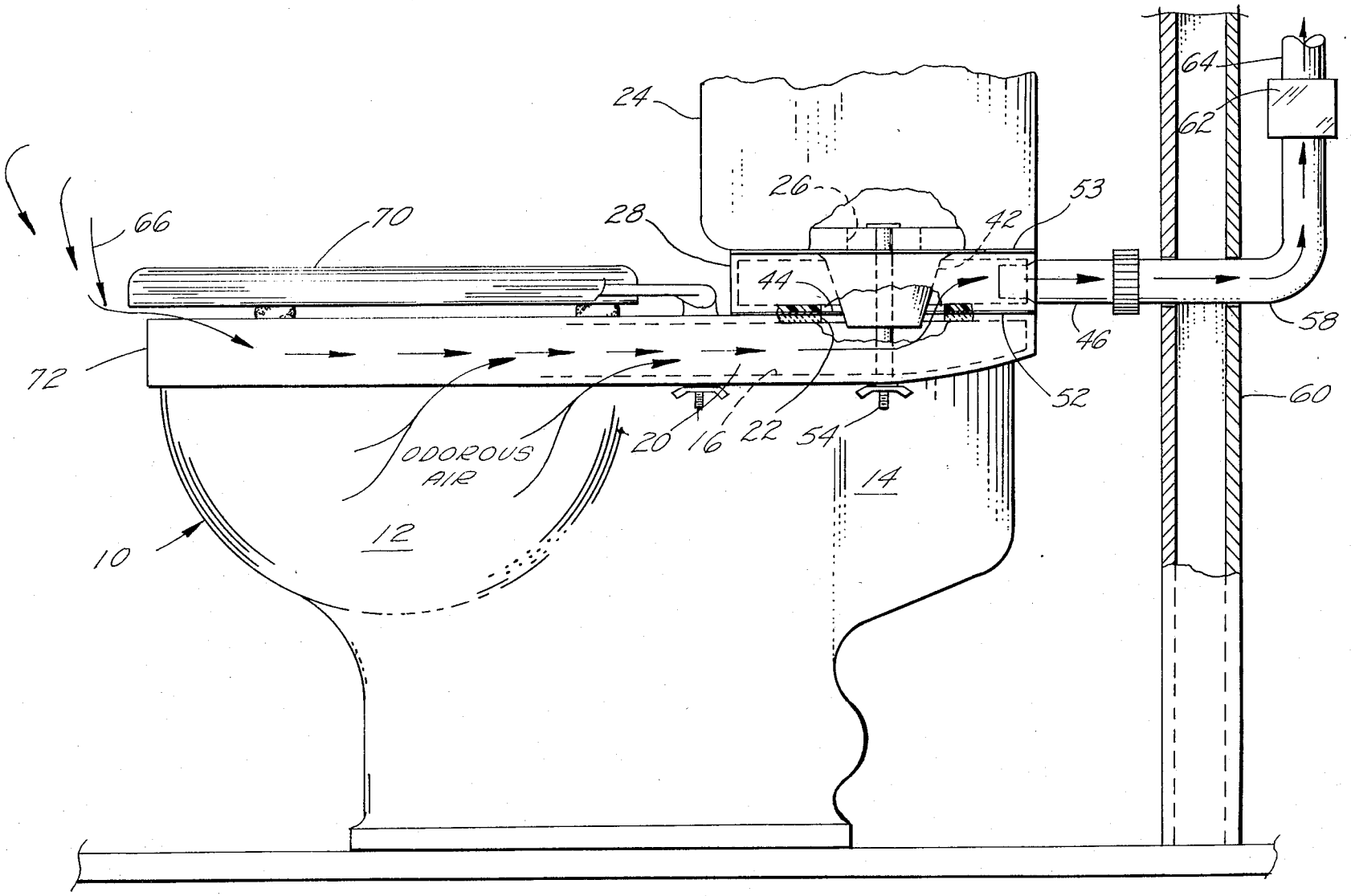
FIG. 1 is a side view, partially sectioned for clarity, of one embodiment of this invention.
Figure 3:
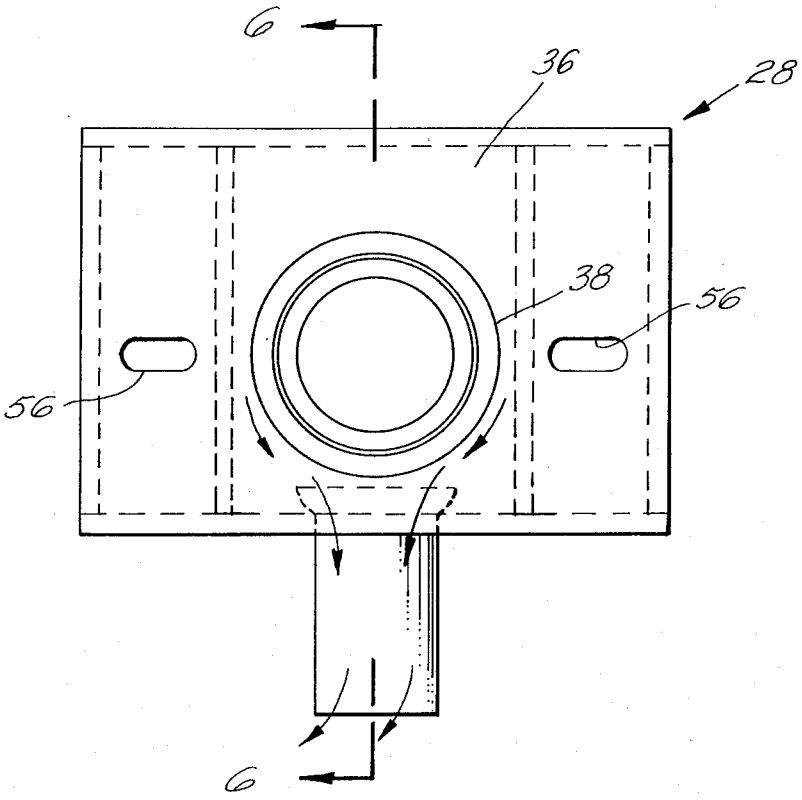
FIG. 3 is a top plan view of the suction housing shown in the preceding figures.
Figure 9:
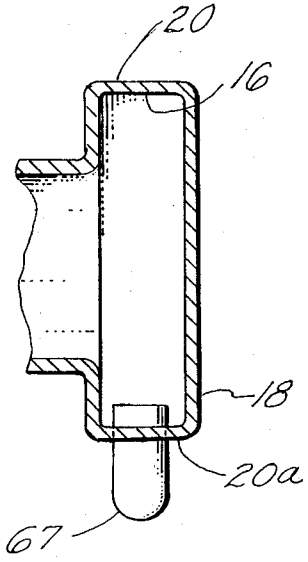
FIG. 9 is a fragmentary cross section taken substantially along section line 9—9 of FIG. 8.
Figure 8:
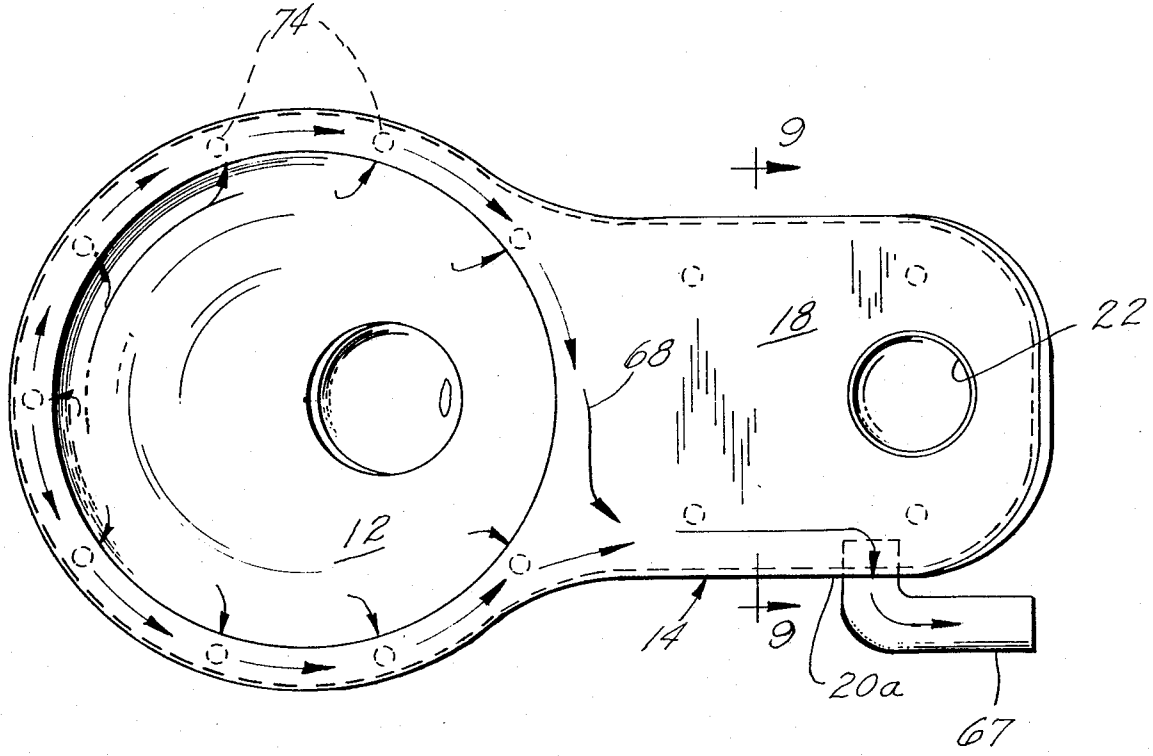
FIG. 8 is a top plan view thereof.

Referring to the drawings, a conventional toilet stool is indicated by the numeral 10 and generally comprises front and rear sections 12 and 14, respectively, wherein the front section 12 is the bowl and the rear section 14 includes the water passage 16 (FIGS. 1 and 9). The bowl 12 has the usual flush apertures around the upper perimeter thereof (not shown) which are in communication with the water passage 16. The passage 16 which extends generally horizontally has top and opposed lateral side 18 and 20 respectively, the top side 18 being generally flat and provided with a water inlet opening 22 (FIGS. 1 and 8). The stool configuration described thus far is conventional.

A conventional water tank 24 normally rests on the top side 18 of the stool with the discharge opening 26 therein being in registry with the water inlet opening 22. Mounted within the tank is the conventional flush-valve mechanism (not shown) which releases water contained within the tank 24 upon manipulation of the flush-valve by an individual. The bottom of the tank 24 as shown is essentially flat.

Figure 6:
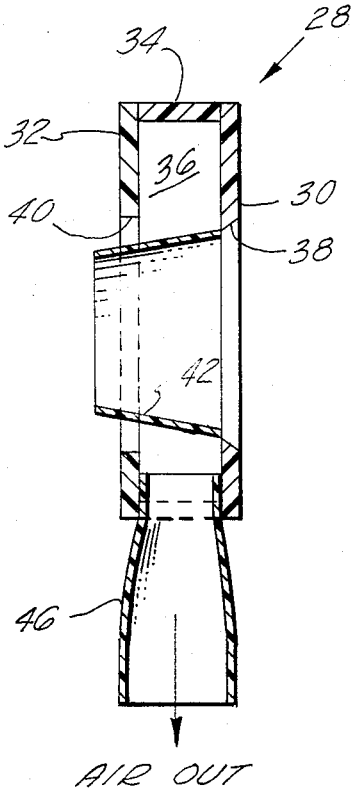
FIG. 6 is a cross section taken substantially along section line 6—6 of FIG. 3.

In this invention, an odor-removing device or suction housing indicated generally by the reference numeral 28 is interposed between the tank and the top side 18 of the stool in load-bearing relation. This suction housing 28 is generally of orthogonal shape and essentially flat having top, bottom and side walls 30, 32 and 34, respectively. These walls are sealingly secured together at the edges defining therebetween a closed chamber 36. The upper wall 30 is provided with a tapered opening 38 centrally thereof. The bottom wall 32 is provided with another opening 40 of about the same size as the opening 38 and in registry therewith. A frustoconically shaped duct or tubular element 42 has its larger diameter end sealingly secured at the perimeter to the annular edge of the opening 38. This duct 42 extends through the chamber 36, the opening 40 and slightly beyond the bottom wall 32 as more clearly shown in FIG. 6. A clearance 44 is provided between the exterior of the duct 42 and the opening 40 thereby to provide for an annular intake port 44 to be described more fully later on.

One of the side walls 34 has a tubular exhaust fitting 46 secured therein in communication with the chamber 36.

The walls of the housing 28 are preferably formed of flat plastic panels fusion sealed at the edges. The top and bottom walls 30 and 32 preferably are flat and parallel and spaced relatively close together with load-bearing partitions or strips 48 extending therebetween.

Figure 2:
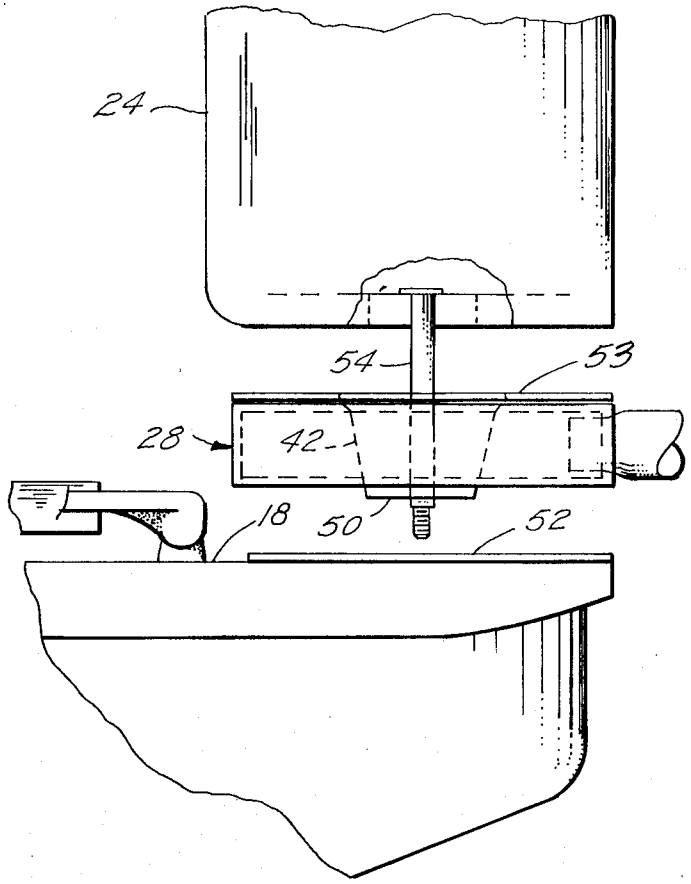
FIG. 2 is a fragmentary exploded view thereof.
Figure 4:
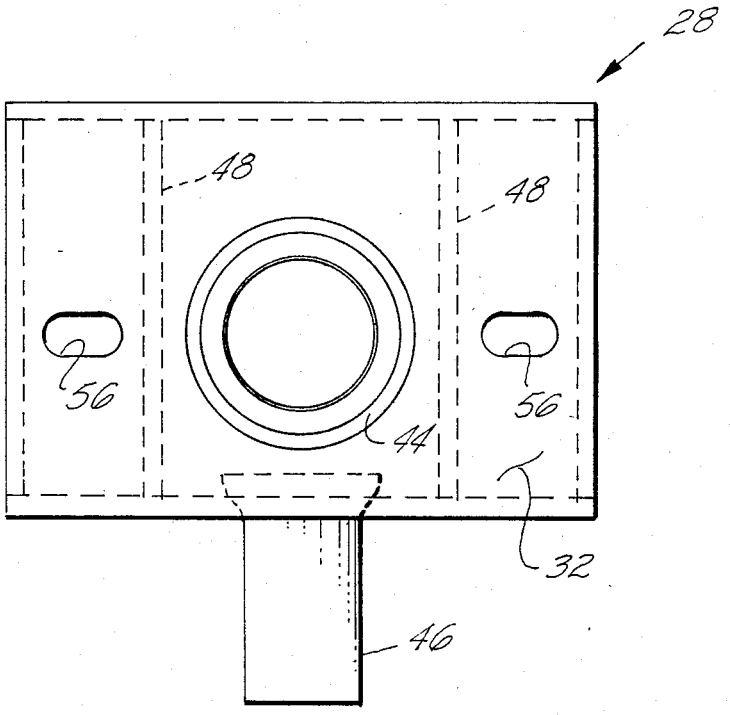
FIG. 4 is a bottom plan view thereof.
Figure 5:
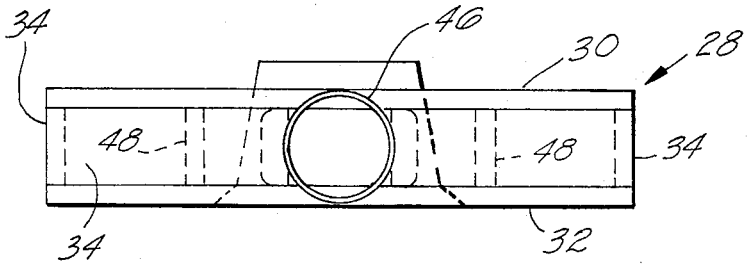
FIG. 5 is a side view showing the exhaust fitting thereon.

As shown more clearly in FIGS. 1 and 2, the housing 28 is interposed between the tank 24 and the top side 18 of the stool. The bottom end 50 of the duct 42 is inserted through the water inlet opening 22 in the stool which is sufficiently large, as shown in FIG. 1, to provide a substantial clearance therewith. This annular clearance is coextensive with intake port 44 and is in registry therewith. A suitable, flat sealing gasket 52 is sandwiched between the bottom wall 32 of the housing and the top side 18 of the stool as shown and another similar gasket 54 is disposed between the top wall 30 in the bottom of the tank 24. As is clearly shown in FIG. 1, the water discharge outlet 26 in the tank 24 is disposed in central registry with the open upper end of the duct 42.

The combination is sealingly and tightly secured together by means of threaded fasteners 54 which pass through suitable openings in the tank bottom, the housing 28 and the rear portion 14 of the stool. The openings in the housing portion are indicated by the numeral 56. Suitable gaskets (not shown) may be provided around these threaded fasteners 54 for the purpose of preventing leakage.

In a typical installation as shown in FIG. 1, a vent pipe 58 passes through the wall 60 of the bathroom and is connected to the discharge fitting 46 on the housing 28. A suitable blower or exhaust fan 62 which is electrically operated is connected to the pipe 58, the opposite end portion 64 of the pipe extending to the outside of the building.

Flushing operation of the stool is conventional, the individual operating the flush handle or valve in the usual manner thereby discharging the water in the tank 24 through the opening 26, the duct 42, through the water inlet opening 22 and into the passage 16 from which it passes to the bowl 12 through the usual flushing orifices. The duct 42 is made large enough so as not to impede this flow of water. Actuating the fan 62 results in drawing a current of air in the direction indicated by the arrows 66 which passes through the bowl 12, the passage 16 upwardly through the external annular portion of the water inlet opening 22, the annular intake port 44 and into the housing chamber 36. From there, such air is sucked out of the fitting 46, through the pipe 58 to the exterior of the building. Any odorous air, therefore, in the stool 12 is exhausted.

It will be seen that the suction housing 28 is adapted to be used with flush-type toilet stools of conventional configuration and is so designed as not to require any modifications to such toilet structure. Air flow through the toilet is in opposition to the direction of water passage up to the point of reaching the water-inlet opening 22, but from that location, air passage circumvents the path of the water flow in being exhausted from the system.

Figure 10:
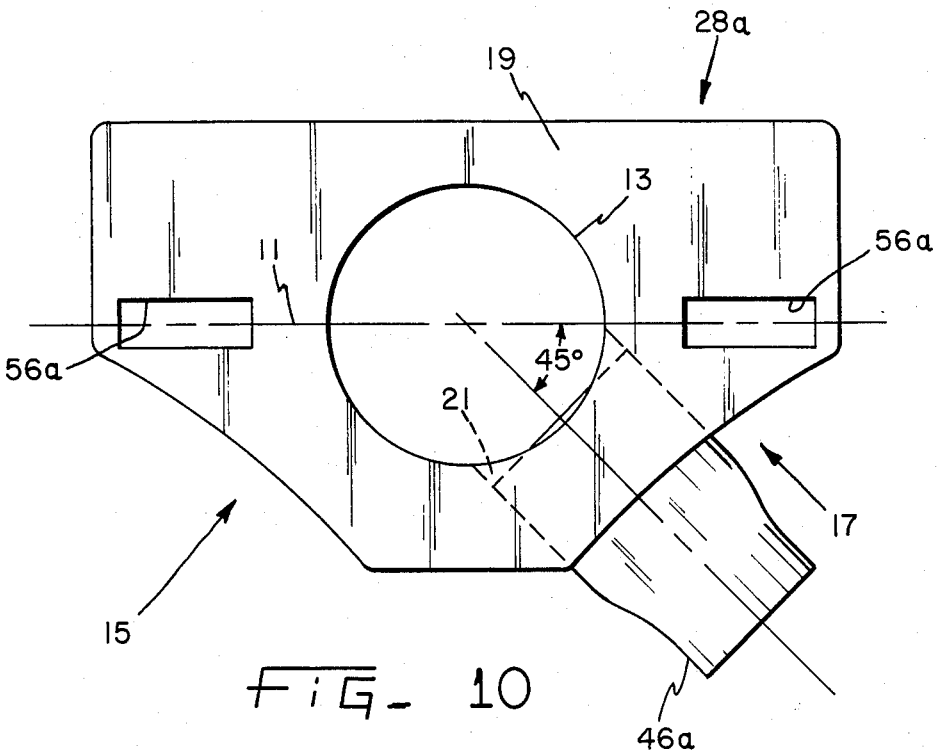
FIG. 10 is a top plan view of a preferred form of suction housing similar to the housing of FIG. 3 but having wider retrofit applicability.
Figure 11:
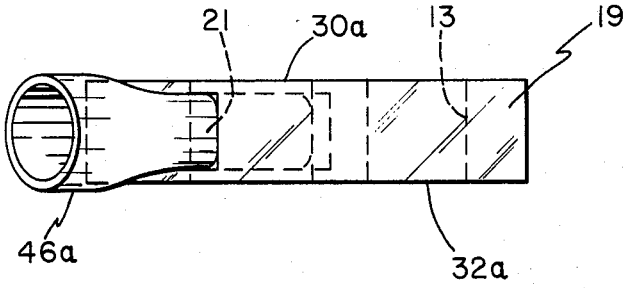
FIG. 11 is a side view of the suction housing of FIG. 10.

Referring to the preferred variation illustrated in FIGS. 10 and 11, the suction housing or spacer **28*a* functions somewhat like spacer 28 of FIGS. 1 through 6 and corresponding reference numerals have been carried over with an "a" designation appended thereto to describe features common between these two versions. The embodiment of FIGS. 10 and 11 is designed for retrofitting to existing flush-type toilets and is designed to obviate several of the problems common to the embodiment of FIGS. 1 through 7 and U.S. Pat. No. 2,777,137 to McFadden. In both the applicant's version illustrated in FIGS. 1 through 6 and the McFadden patent the vent or exhaust pipe extends rearwardly from the toilet beneath the flush water supply tank necessitating either that the toilet be spaced away from a wall or that any wall immediately behind the tank be provided with a hole so that the exhaust venting system may pass through the wall and away from a bathroom. With the embodiment illustrated in FIGS. 10 and 11 the exhaust fitting 46*a* extends obliquely at about a 45° angle to the center line 11 of the spacer aperture 13 where that center line extends generally in the same direction as the direction of elongation of mounting bolt passing elongated slots 56*a*. This side exiting feature allows the mounting of the toilet supply tank closely adjacent to a wall in the same manner as the version illustrated in FIGS. 7, 8 and 9**.

It will also be noted that the spacer **28*a* is cut away in the regions 15 and 17. The purpose for this cut away region is to allow for certain variations in toilet designs where in some cases the rear portion of the toilet stool which includes the water passageway also has so called leveler bumps which function to support the flush water supply tank. When the spacer of the present invention is interposed between the rear stool portion and the water supply tank these leveler bumps would otherwise cause misalignment, however, due to the cut away regions 15 and 17 no such misalignment problem is encountered. It will further be noted that due to the symmetry of the spacer as illustrated in FIGS. 10 or 11 the exhaust fitting or air vent 46*a* may extend rearwardly and toward the left or toward the right depending upon which face 30*a* or 32*a* is positioned upwardly. The spacer or suction housing 28*a* will be interposed between the flush water supply tank and rear portion of a toilet stool in substantially the same manner as discussed earlier in conjunction with FIGS. 1 through 6 with upper and lower sealing gaskets of conventional design positioned respectively between the spacer and supply tank and the spacer and stool rear portion. Also as in the earlier version the elongated slots 56***a* will receive stool tank mounting bolts for a wide variety of toilet designs.

In the specific suction housing or spacer illustrated in FIGS. 10 and 11 the spacer aperture 13 is generally cylindrical and about two and three quarter inches in diameter while the spacer thickness or height of the cylindrical aperture is about one inch. The conduit or exhaust fitting 46*a* is about one and three eight inches in diameter and blends or is deformed from a circular shape into an elliptical or nearly rectangular shape at the vent opening in the side wall of the spacer aperture.

Since the spacer aperture 13 of FIGS. 10 and 11 is a generally cylindrical hole, the conical duct arrangement 42 of the version of FIGS. 1 through 6 is no longer employed. The body 19 may as in the earlier version be hollow employing load bearing partitions or may be formed from a solid block of material such as a plastic material if desired. So long as the block 19 includes the elongated mounting holes 56*a* the flush water conveying passage 13 and the horizontally extending air vent opening 21 which connects to the exhaust fitting 46*a* and the cut away regions 15 and 17 to accommodate the device to any of several toilet designs the remaining structure for body 19 may be of any of a wide variety of designs.

Figure 7:
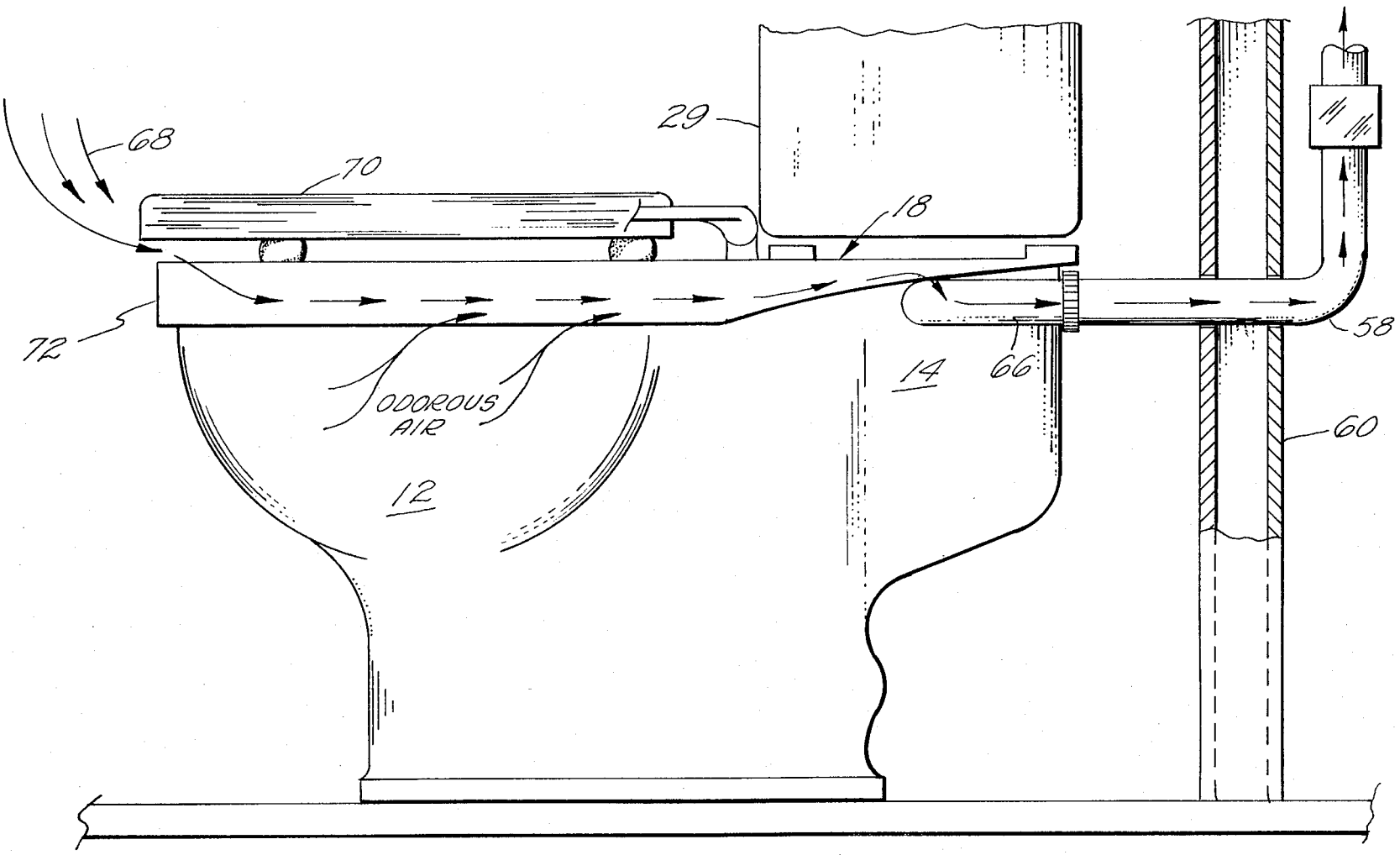
FIG. 7 is a side view of another embodiment of this invention.

In all of the embodiments of FIGS. 1, 7 and 10, ambient, scavenging air not only is drawn through the bowl 12 from the region between the hinged toilet seat 70 and the rim 72 of the bowl, but also from the interior of the bowl 12 itself, this scavenging air flowing upwardly through the flush holes 74 disposed in the bottom of the hollow bowl rim 72. This hollow rim 72 is annular and in direct communication with the water passage 16. Thus, any odors which might escape from the stool into the ambient air may be scavenged as well as those within the bowl itself.

User preference will determine which of the embodiments should be installed. It is conceivable that in some instances it would not be conveniently possible to install an exhaust fitting like fitting 67 of FIG. 8, in which event use of the suction housing 28 or 28*a* would be preferred. Both arrangements, of course, serve effectively to scavenge odorous air from the bowl and the vicinity surrounding the bowl in an efficient manner.

In comparing the embodiments of FIGS. 1 through 6 and FIGS. 10 and 11, the latter is preferred since it allows for much closer mounting of the toilet against a wall and further it allows for either right hand or left hand exiting of the exhaust fitting 46*a* as desired for a particular installation. Still further the latter embodiment allows relief portions to accommodate the so called leveler bumps encountered on certain stools making the embodiment of FIGS. 10 and 11 suitable for use on a wide variety of toilet designs.

While there have been described above the principles of this invention in connection with specific apparatus, it is to be clearly understood that this description is made only by way of example and not as a limitation to the scope of the invention.

What is claimed is:

1. In a flush type toilet having a toilet stool with front and rear portions and a flush water supply tank superposed over the rear portion, said front portion being a bowl and the rear portion including a water passage for conveying flush water from the supply tank to the bowl, the improvement comprising a generally flat aperture unitary spacer interposed between he rear portion and supply tank with the spacer aperture forming a path for flush water from the tank to the rear portion water passage, said spacer having opposite, spaced and parallel mounting surfaces engageable with said supply tank and said rear portions, a horizontally extending air vent opening in said spacer between said surfaces communicating with the spacer aperature, an air vent passage in said spacer between and parallel to said surfaces extending from the opening so that the air vent is positioned beneath the supply tank to allow the supply tank to be positioned immediately adjacent a wall of the bathroom without interference between the wall and air vent, two mounting holes in said spacer on diametrically opposite sides respectively, of said aperture, said mounting holes being elongated in a direction parallel to a line drawn therebetween, said passage having an axis that extends at an acute angle with respect to said line and means for conveying air from the vent to a location remote from the toilet thereby drawing air from around and within the toilet bowl by way of the water passage and spacer aperture in a direction counter to the direction of normal flush water flow through the water passage and into the bowl.

2. The improvement of claim 1 further comprising upper and lower sealing gaskets positioned respectively between the spacer and supply tank and the spacer and stool rear portion.

3. The improvement of claim 1 wherein the spacer aperture is generally cylindrical about 2 and ¾ inches in diameter and 1 inch long, and the vent is generally circular and about 1 and ⅜ inches in diameter with the vent being deformed from its circular shape near the aperture to smoothly blend into the air vent opening.

4. The improvement of claim 1 wherein the spacer is provided with bolts which pass through said elongated mounting holes for connecting the tank and stool rear portion, the slots symmetricaly spanning the aperture and being elongated generally along a line passing through the center of the aperture so as to accommodate the same spacer to any selected one of several different toilet designs.

5. The improvement of Claim 4 wherein the air vent passage extends obliquely at about 45° to the line of the elongated slots.

* * * * *